US006750745B1

(12) United States Patent
Wei et al.

(10) Patent No.: US 6,750,745 B1
(45) Date of Patent: Jun. 15, 2004

(54) MICRO MAGNETIC SWITCHING APPARATUS AND METHOD

(75) Inventors: Chengping Wei, Gilbert, AZ (US); Jun Shen, Phoenix, AZ (US); Gordon Tam, Gilbert, AZ (US)

(73) Assignee: Magfusion Inc., Chandler, AZ (US)

( * ) Notice: Subject to any disclaimer, the term of this patent is extended or adjusted under 35 U.S.C. 154(b) by 0 days.

(21) Appl. No.: 10/229,227

(22) Filed: Aug. 27, 2002

Related U.S. Application Data

(60) Provisional application No. 60/315,651, filed on Aug. 29, 2001.

(51) Int. Cl.[7] ..... H01H 51/22
(52) U.S. Cl. ..... 335/78
(58) Field of Search ..... 335/78–81; 200/181; 337/14

(56) References Cited

U.S. PATENT DOCUMENTS 6,016,092 A * 1/2000 Qiu et al. ..... 333/262
6,124,650 A * 9/2000 Bishop et al. ..... 335/78
6,181,460 B1 * 1/2001 Tran et al. ..... 359/291
6,310,526 B1 * 10/2001 Yip et al. ..... 333/262
6,629,461 B2 * 10/2003 Behin et al. ..... 73/514.16
6,633,212 B1 * 10/2003 Ruan et al. ..... 335/78
2003/0151479 A1 * 8/2003 Stafford et al. ..... 335/78
2003/0202234 A1 * 10/2003 Taylor et al. ..... 359/291
2003/0222740 A1 * 12/2003 Ruan et al. ..... 335/78

* cited by examiner

*Primary Examiner*—Lincoln Donovan
*Assistant Examiner*—Bernard Rojas
(74) *Attorney, Agent, or Firm*—Parsons & Goltry; Robert A. Parsons; Michael W. Goltry

(57) ABSTRACT

Micro magnetic switching apparatus includes a permanent magnet supported on a base and a coil supported by the base so as to define a plurality of sides. A plurality of latching micro magnetic relays each includes a magnetic cantilever positioned to open a first electric circuit in a first orientation and to close the first electric circuit in a second orientation. One each of the relays is mounted adjacent each of the plurality of sides of the coil and adjacent the permanent magnet so as to be latched in one of the first and second orientations when the coil is not activated and to switch to the other of the first and second orientations when the coil is activated and to be latched in the other of the first and second orientations by the permanent magnet.

7 Claims, 7 Drawing Sheets

FIGURE 1
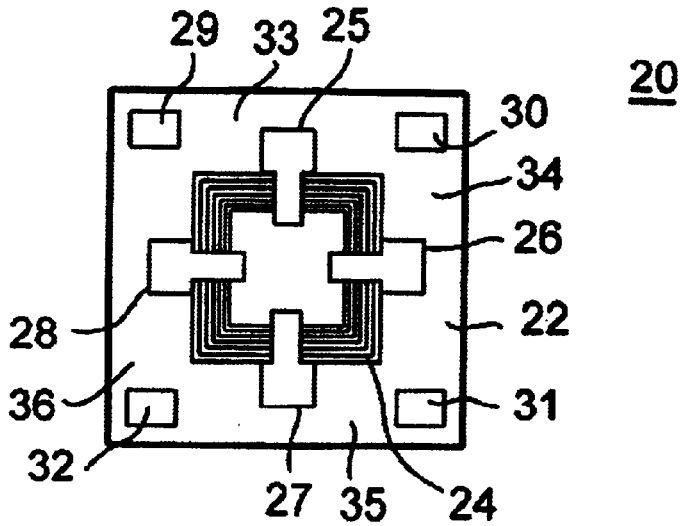
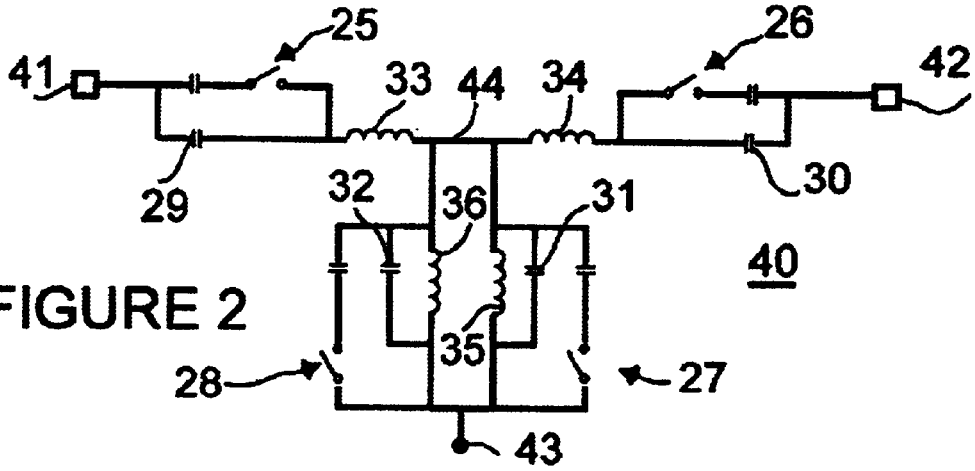
FIGURE 2
FIGURE 3
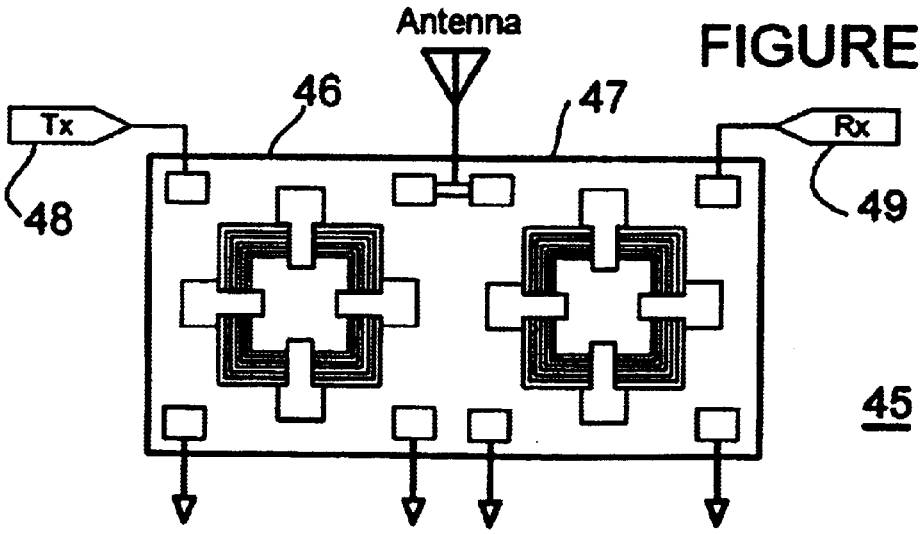

FIGURE 4
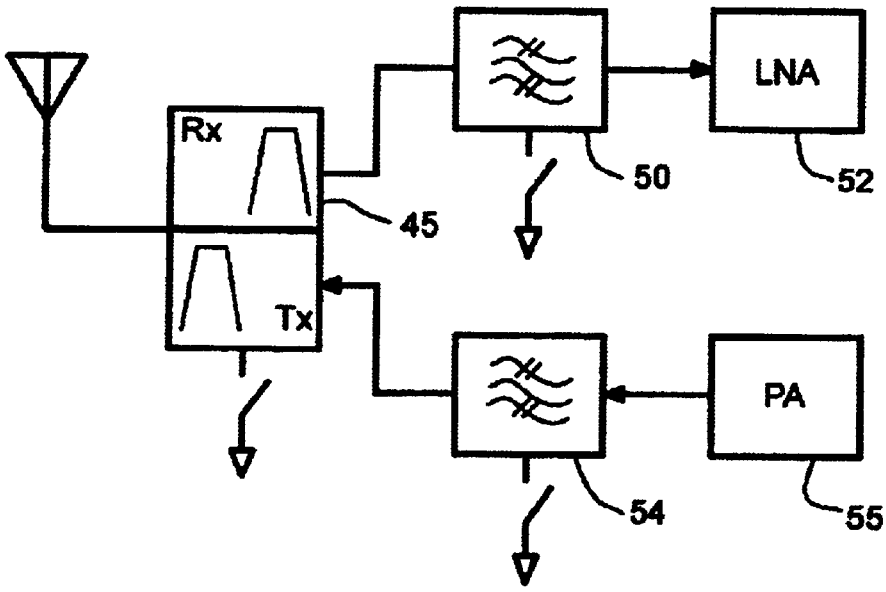
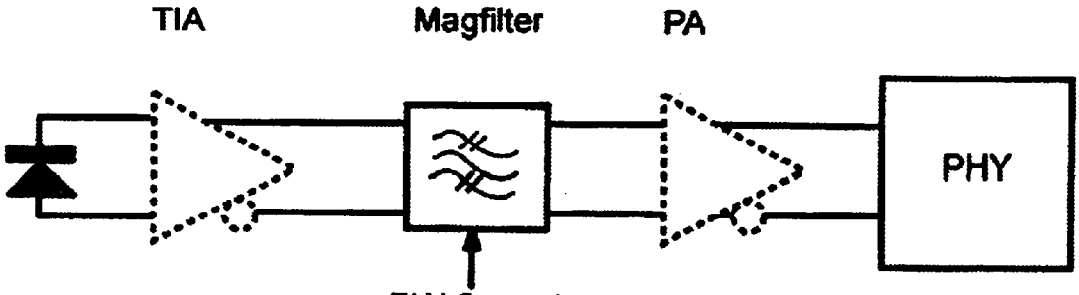
FIGURE 5
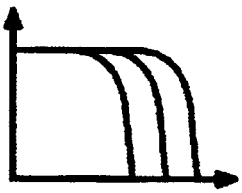
FIGURE 6

FIGURE 7
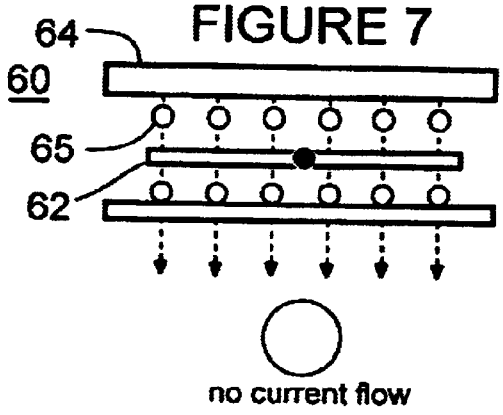
FIGURE 8
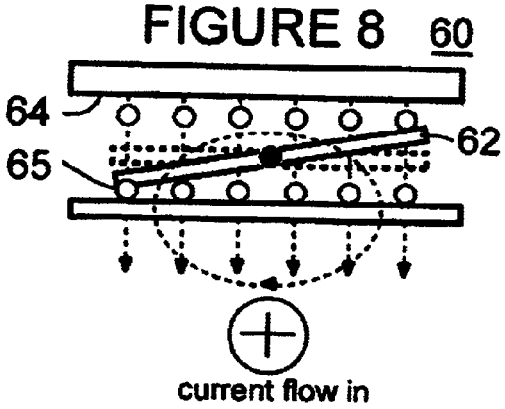
FIGURE 9
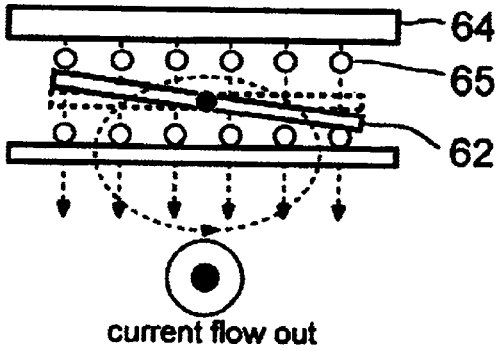
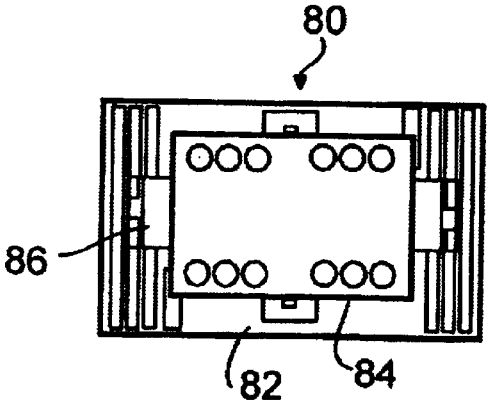
FIGURE 13
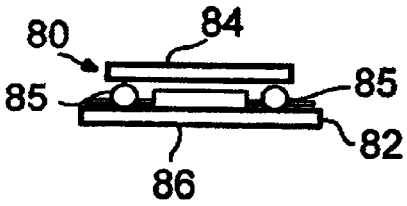
FIGURE 14

MICRO MAGNETIC SWITCHING APPARATUS AND METHOD

CROSS-REFERENCE TO RELATED APPLICATION

This application claims the benefit of provisional patent application Ser. No. 60/315,651, filed Aug. 29 2001.

FIELD OF THE INVENTION

This invention relates to latching micro magnetic relays.

More particularly, the present invention relates to latching micro magnetic relays, various applications, and methods of manufacture.

BACKGROUND OF THE INVENTION

High frequency switchable band pass filters are widely used in telecom and datacom applications. Competition and new applications have driven the filters used in this field to smaller size, better performance, higher frequency, and yet at very low cost. Gallium arsenide (GaAs) field effect transistor (FET) based switching filters have been developed for this purpose. The GaAs FET based switching filters are inexpensive but they do not perform at frequencies above 2 GHz.

Recently, novel latching micro magnetic relays were discovered. The novel latching micro magnetic relay is based on preferential magnetization of a soft magnetic cantilever in a permanent external magnetic field. Switching between two magnetic states is accomplished by momentarily changing the direction of the cantilever's magnetization by passing a short current pulse through a planar coil situated adjacent the cantilever. Once the relay is switched, it is held in this nonvolatile state (latched) by the permanent external magnetic field. Additional information as to the construction and operation of the novel latching micro magnetic relay is disclosed in a co-pending United States patent application entitled "Electronically Switching Latching Micro-Magnetic Relay and Method of Operating Same", with Ser. No. 09/496,446, filing date Feb. 2, 2000, and incorporated herein by reference.

Latching micro magnetic relays have never been used as switching apparatus in, for example, high frequency switchable band pass filters.

Accordingly, it is an object the present invention to provide new and improved micro magnetic switching apparatus for use in, for example, high frequency switchable band pass filters and the like.

Another object of the present invention is to provide new and improved micro magnetic switching apparatus in a high frequency switchable band pass filter with very low insertion loss and high Q at very high frequency, e.g., up to 20 GHz.

And another object of the present invention is to provide new and improved micro magnetic switching apparatus used in a high frequency switchable band pass filter that is smaller size, has better performance, is inexpensive, and operates at much higher frequency.

A further object of the present invention is to provide new and improved micro magnetic switching apparatus constructed to require substantially smaller switching currents to perform the switching function.

A further object of the present invention is to provide new and improved micro magnetic switching apparatus for use in electronic circuits, such as duplexers, 1×2 multiplexing switches, 2×2 differential switches, and the like.

SUMMARY OF THE INVENTION

Briefly, to achieve the desired objects of the present invention in accordance with a preferred embodiment thereof, provided is micro magnetic switching apparatus including latching micro magnetic relays. A permanent magnet is supported on a base. A coil is supported by the base and positioned to define a plurality of sides. A plurality of latching micro magnetic relays each includes a magnetic cantilever positioned to open an electric circuit in a first orientation and to close the electric circuit in a second orientation. One each of the latching micro magnetic relays is mounted adjacent each of the plurality of sides of the coil and adjacent the permanent magnet so as to be latched in one of the first and second orientations when the coil is not activated. When the coil is activated the latching micro magnetic relays switch to the other of the first and second orientations and are latched in the other of the first and second orientations by the permanent magnet. Because of the latching feature, the micro magnetic switching apparatus uses zero latching current once the switching has been accomplished. The plurality of latching micro magnetic relays can each open and close a different electric circuit or they can all operate on a common electric circuit.

In some embodiments, the micro magnetic switching apparatus includes a plurality of coils with each coil defining a plurality of sides and each side associated with a latching micro magnetic relay. These embodiments may be fabricated on a single base with a single permanent magnet or they could be fabricated as individual devices, each on a base with a permanent magnet. Also, while the permanent magnet (e.g., a piece of magnetized magnetic material) is believed to be the most efficient and easy to fabricate, it will be understood that in some specific applications it may be desirable to form the permanent magnet from material that is magnetized by a small electric current that is applied when the circuit is in operation.

In a further embodiment, micro magnetic switching apparatus is constructed with a base and a permanent magnet supported by the base. A coil is supported by the base and folded to define a first portion and a second portion with the first portion providing a first magnetic field and the second portion providing a second magnetic field when the coil is activated. The first and second portions are positioned so that the first magnetic field and the second magnetic field combine to produce a composite magnetic field greater than either of the first and second magnetic fields between the first and second portions. A latching micro magnetic relay, including a magnetic cantilever, is positioned between the first and second portions of the coil. The latching micro magnetic relay is constructed to open an electric circuit in a first orientation and to close the electric circuit in a second orientation and is further positioned relative to the permanent magnet so as to be latched in one of the first and second orientations when the coil is not activated and to switch to the other of the first and second orientations when the coil is activated and to be latched in the other of the first and second orientations by the permanent magnet. Thus, this novel embodiment uses substantially less switching current, because of the folded coil.

BRIEF DESCRIPTION OF THE DRAWINGS

The invention will become readily apparent to those skilled in the art from the following detailed description of preferred embodiments thereof, taken in conjunction with the drawings in which:

FIG. 1 is a four-switch latching micro magnetic relay in accordance with the present invention;

FIG. 2 is a schematic drawing of a high frequency switchable band pass filter incorporating the four-switch latching micro magnetic relay of FIG. 1;

FIG. 3 is an antenna duplexer incorporating two four-switch latching micro magnetic relays;

FIG. 4 is a simplified block diagram of the front end of a transceiver incorporating the antenna duplexer of FIG. 3;

FIG. 5 is a simplified block diagram of an optical fiber communication channel incorporating a multi-switch latching micro magnetic relay;

FIG. 6 is a graphical representation of the bandpass capabilities of the multi-switch latching micro magnetic relay of FIG. 5;

FIGS. 7, 8, and 9 are side views illustrating three positions of another embodiment of a latching micro magnetic relay in accordance with the present invention;

FIGS. 13 and 14 are top and end views illustrating another embodiment of a latching micro magnetic relay in accordance with the present invention;

DETAILED DESCRIPTION OF THE PREFERRED EMBODIMENTS

Figure 10:
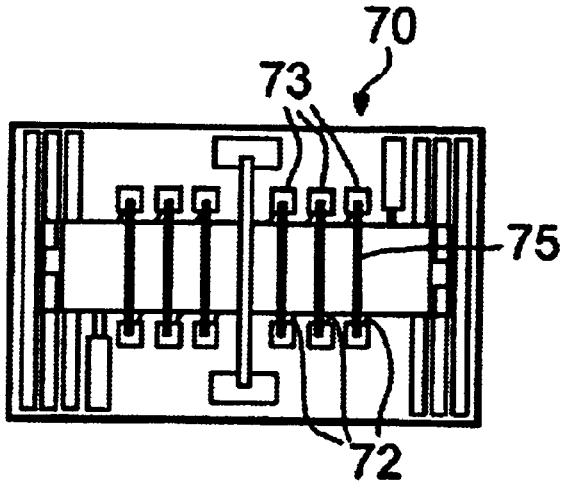
FIGS. 10, 11, and 12 are top, end, and isometric views, respectively, illustrating one method of manufacturing the latching micro magnetic relay of FIG. 7.

Turning now to the drawings, attention is directed to FIG. 1 which illustrates a four-switch latching micro magnetic relay 20 in accordance with the present invention. Relay 20 is formed on a base 22 including a substrate and a permanent magnet situated to provide the desired external magnetic field, as explained in more detail in the above described patent application. A planar coil 24 is positioned on the surface of base 22 in a generally rectangular configuration so as to provide four sides. Latching micro magnetic relays 25, 26, 27, and 28 are positioned, one each, on each side of coil 24. All of relays 25, 26, 27, and 28 are similar and each relay includes a soft magnetic cantilever mounted in the permanent magnetic field produced by coil 24 and connected to close an electrical circuit in one orientation and open the electrical circuit in a second orientation. As explained in more detail in the above described patent application, the permanent magnet in base 22 holds or latches each of the cantilevers of relays 25, 26, 27, and 28 in either the closed or open orientation. All of relays 25, 26, 27, and 28 can be switched, simultaneously, from a present latched orientation to the opposite orientation by passing a current through coil 24. Also, in this embodiment, capacitors 29, 30, 31, and 32 and inductors 33, 34, 35, and 36 are formed on base 22 and coupled to relays 25, 26, 27, and 28 to form a desired circuit.

High frequency switchable band pass filters are widely used in telecom and datacom applications. Competition and new applications have driven these and other types of filters to smaller sizes, better performance, higher frequencies, and at lower costs. GaAS field effect transistor (FET) based switching filters are expensive and do not perform well, if at all, at frequencies higher than 2 GHz.

Referring, for example, to FIG. 2, a high frequency switchable band pass filter 40 preferably incorporating four-switch latching micro magnetic relay 20 is illustrated schematically. While filter 40 is described as preferably incorporating relay 20, it will be understood that each of the relays connected therein could be implemented as separate relays of the type disclosed in the above described patent application. Filter 40 includes an input terminal 41, an output terminal 42 and a common or ground terminal 43. In this specific embodiment, capacitor 29 is connected in series with inductor 33 between input terminal 41 and a junction 44. Capacitor 30 is connected in series with inductor 34 between junction 44 and output terminal 42. Capacitor 31 is connected in parallel with inductor 35 between junction 44 and ground 43. Capacitor 32 is connected in parallel with inductor 36 between junction 44 and ground 43. This combination forms a band pass filter with a first band pass.

In addition to the above described circuitry, filter 40 includes relay 25 connected in parallel with capacitor 29, relay 26 connected in parallel with capacitor 30, relay 27 connected in parallel with capacitor 31, and relay 28 connected in parallel with capacitor 32. Again it should be understood that in this specific embodiment relays 25, 26, 27, and 28 are embodied in single four-switch latching micro magnetic relay 20. Also, it should be understood that relays 25, 26, 27, and 28 are constructed so that in the closed position the cantilever of each relay provides a known and adjustable amount of capacitance (due at least in part to the proximity of the cantilever to the base in the closed position). Changes in the amount of capacitance provided by the relays can be achieved, for example, by adjusting the size and proximity of the cantilever, changes in the materials, etc. In some applications it may be desirable to add an additional external capacitor in series with the relay.

Thus, with relays 25, 26, 27, and 28 closed a second capacitance is connected in parallel with fixed capacitors 29, 30, 31, and 32, respectively. The parallel capacitances change the band pass of filter 40 to a second, different band pass. Clearly, additional capacitors could be connected in a similar fashion to provide further different pass bands, if desired. Filter 40 has very low insertion losses and a high Q at very high frequency (e.g. up to 20 GHz). Further, four-switch latching micro magnetic relay 20 is relatively simple to fabricate, lending itself naturally to automated production, and, thus, is a good choice for switchable band pass filter 40.

Turning now to FIG. 3, an antenna duplexer 45 incorporating two four-switch latching micro magnetic relays 46 and 47 is illustrated. In this embodiment, relays 46 and 47 are similar to four-switch latching micro magnetic relay 20 and provide a band pass filter switchable between first and second pass bands. An antenna is connected to the output terminal of relay 46 and to the input terminal of relay 47. A transmitter 48 is coupled to the input terminal of relay 46 and a receiver 49 is connected to the output terminal of relay 47 for processing received signals. Thus, by actuating the coils included in relays 46 and 47, duplexer 45 can be tuned to either of a first and a second band pass for the correct operation of the transmitter and receiver in accordance with normal operation. Once the relays are in the desired position, power can be removed from the coils and the cantilevers will remain latched in the selected position. The cantilevers can easily be designed with different sizes and spacings to provide different amounts of capacitance. Further, lower order filters can be constructed with fewer switches and filters with more pass bands can be constructed with more switches. Also, with the same structure one can easily fabricate multi-band duplexers.

Referring additionally to FIG. 4, a simplified block diagram of the front end of a transceiver incorporating antenna duplexer 45 is illustrated. Three specific pass bands are included purposes of for example: 925–960, 1805–1880, 1930–1990 for coupling signals from the antenna to the receiver and 880–915, 1710–1785, 1850–1910 for coupling signals from the transmitter to the antenna. A multi-pass band switchable filter 50 (switchable between the bands 925–960, 1805–1880, and 1930–1990) is included to couple signals from the output of antenna duplexer 45 to operating circuits 52. Similarly, a multi-pass band switchable filter 54 (switchable between the bands 880–915, 1710–1785, 1850–1910) is included to couple signals from the output of a transmitter 55 to antenna duplexer 45. It will of course be understood that the specific frequencies described are only for purposes of explanation and any desirable frequencies and applications can be used.

Referring additionally to FIG. 6, a graphical representation of the pass bands for switchable filters 50 and 54 is illustrated. Here it should be understood that a multi-switch latching micro-magnetic relay similar to four-switch latching micro magnetic relay 20 is used to implement switchable filters 50 and 54. To provide the three bands (or more if desired) relays similar to relay 20 can be connected using more or less cantilever switches, as the application requires.

Latching micro magnetic relays of the type discussed above are self-latching wafer level micro switches generally in the micro-electro-mechanical system (MEMS) technologies. These devices provide a unique solution in applications where power consumption and physical size are concerned. Referring to FIGS. 7, 8, and 9, side views are provided illustrating three positions of another embodiment of a latching micro magnetic relay 60 in accordance with the present invention. Relay 60 includes three main components: a cantilever 62; a magnet 64; and a coil 65. In the embodiments previously disclosed (see the above cited patent application), all three of these components were fabricated on either a silicon or GaAs substrate, or other high resistive substrate. In the above-described patent application, a planar, generally rectangular coil is positioned on the surface of the substrate and a mounting post for the cantilever is positioned in the center of the coil. The cantilever is attached at one end to the post and the other end is free to engage, or not engage, a contact on the substrate. Here it will be noted that only half of the coil is used to switch the relay.

In the embodiment illustrated in FIGS. 7, 8, and 9, cantilever 62 is mounted in the middle so that it extends outwardly in both directions and can engage contacts positioned on the substrate at either end by rotating counter clockwise, as illustrated in FIG. 8, or by rotating clockwise, as illustrated in FIG. 9. Also, coil 65 is essentially folded so that approximately one half is positioned below cantilever 62 and approximately one half is positioned above cantilever 62. In this fashion the entire coil 65 is used to provide a field for switching cantilever 62. Thus, with the same number of coil turns the magnetic field strength density along the cantilever will be higher, compared to the two-dimensional structure previously disclosed with the same level of driving power. By reducing the switching current, if a field equivalent to the field supplied in previous devices is satisfactory, an equivalent switching field can be provided with reduced power and cost. Also, by utilizing the three-dimensional coil a smaller and more compact device can be fabricated. In addition, easier access to the contacts and to the cantilever is provided so that better contacts can be made, there is less chance of interference with the coil, and higher frequencies can be used in the switched circuits.

As illustrated in FIG. 7, with no current applied, cantilever 62 can be positioned substantially parallel to the substrate and no contact is made at either end. When current is applied to coil 65, depending on the current flow direction and the polarity of permanent magnet 64, cantilever 62 will either tilt to the left or to the right and make contact with a pad on the substrate providing the switching function. The level of switching current is a function the number of turns in coil 65 and the magnetic field density (created by the current through coil 65) along cantilever 62. By applying a current to coil 65 which flows into the figure, as illustrated in FIG. 8, cantilever 62 is rotated counter clockwise and the left end moves into contact with the substrate. The field produced by permanent magnet 64 latches or holds cantilever 62 in this position even after current is removed from coil 65. By applying a current to coil 65, which flows out of the figure, as illustrated in FIG. 9, cantilever 62 is rotated clockwise and the right end moves into contact with the substrate. The field produced by permanent magnet 64 latches or holds cantilever 62 in this position even after current is removed from coil 65.

Figure 11:
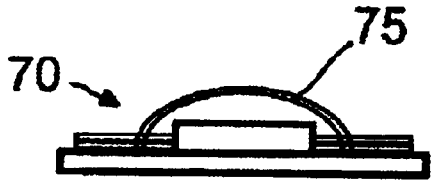
Figure 12:
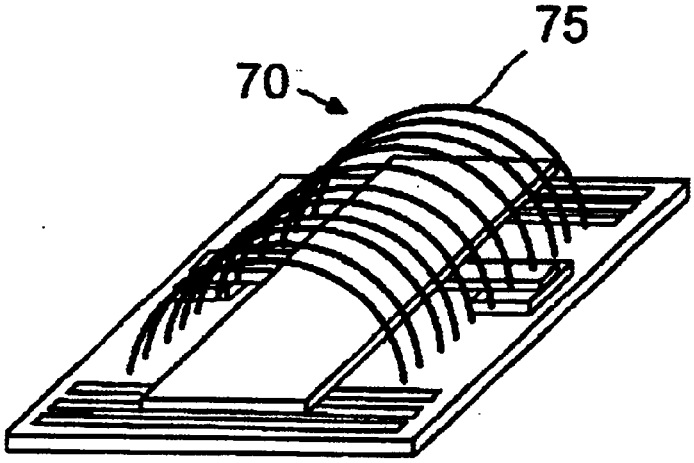

Referring additionally to FIGS. 10, 11, and 12, an embodiment of a three dimensional coil 70 is illustrated in which a lower portion 72 of coil 70 is formed on the surface of the substrate, along with contact pads 73. Coil 70 is then completed using a wire bonding machine to form wire bonds 75 between appropriate contact pads 73. In this fashion a complete three dimensional coil 70 is formed. Wire bonds 75 can be formed of gold, aluminum, or other high conductivity wires. In this embodiment the permanent magnet will generally be positioned below the substrate.

Turning now to FIGS. 13 and 14, another embodiment of a three-dimensional coil 80 is illustrated. In this embodiment a lower portion of coil 80 is formed on the surface of a substrate 82, along with contact pads. A second portion of coil 80 is formed on a flip-chip 84 along with contact pads. Flip-chip 84 is then mounted in overlying relationship on substrate 82 by using some convenient apparatus, such as solder balls 85. Here it should be noted that sufficient spacing must be left between substrate 82 and flip-chip 84 to allow for movement of a cantilever 86. Generally, solder balls 85 are sufficiently large in diameter (even after melting to provide contact and physical mounting) to allow for movement of cantilever 86. It will of course be understood that other mounting structures could be used if desired.

Cross point switches are important elements in fiber optic communication systems and in other systems. In the prior art, electrical cross point switches are bit rate dependent and consume large amounts of power. On the other hand, prior art MEMS based optical cross point switches are not mature enough for low cost manufacturing and mechanically are very bulky and expensive. The MEMS based electrical cross point switches described below have low insertion loss, broad bandwidth, and are low cost to manufacture. These characteristics allow the novel new switches to be incorporated without the need for input and output buffering and they are bit rate independent, bi-directional, low power consumption, easy to control, and have small package size. Further, because the new switches require zero latching current the new cross point switches have many advantages over prior art cross point devices.

Figure 15:
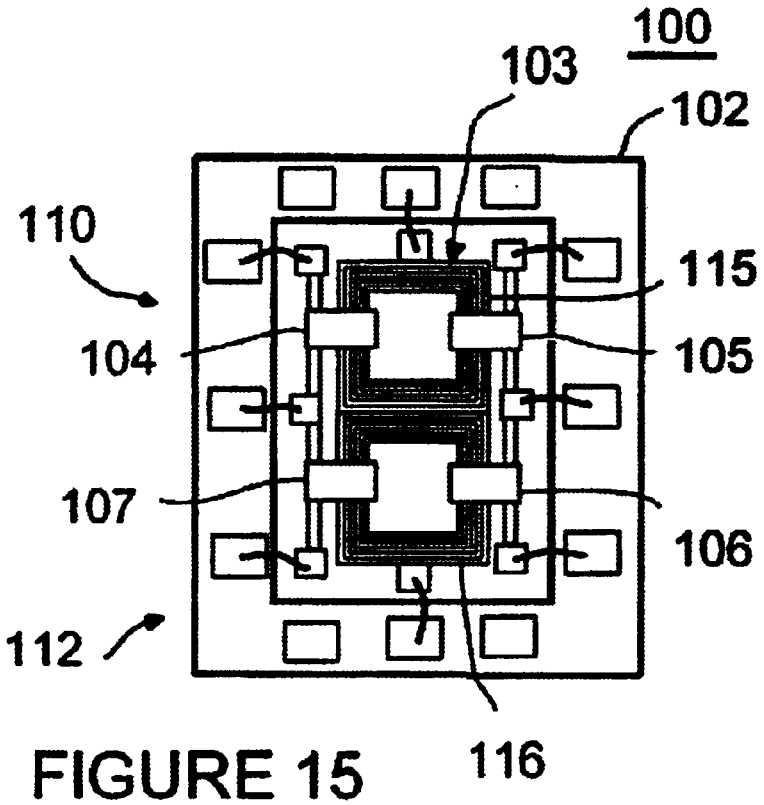
FIG. 15 is a view in top plan of a novel cross point switch in accordance with the present invention.

Turning now to FIG. 15, a cross point switch 100 is illustrated. Switch 100 is formed on a substrate 102, generally as previously described. Switch 100 is a latching micro magnetic relay that operates generally as relay 20 described above. Switch 100 includes a permanent magnet, a coil 103, and four cantilevers 104, 105, 106, and 107. In this embodiment, switch 100 is fabricated in an upper and a lower section 110 and 112, respectively. Further, coil 103 is formed with an upper rectangularly shaped portion 115 positioned in upper section 110 and a lower rectangularly shaped portion 116 positioned in lower section 112. Upper portion 115 and lower portion 116 are wound in opposite directions to provide a coil referred to herein as an "S" shaped coil. Cantilevers 104 and 105 are positioned on opposite sides of portion 115 of coil 103 and cantilevers 106 and 107 are positioned on opposite sides of portion 116 of coil 103. Also, contact pads are provided on substrate 102.

Figure 16:
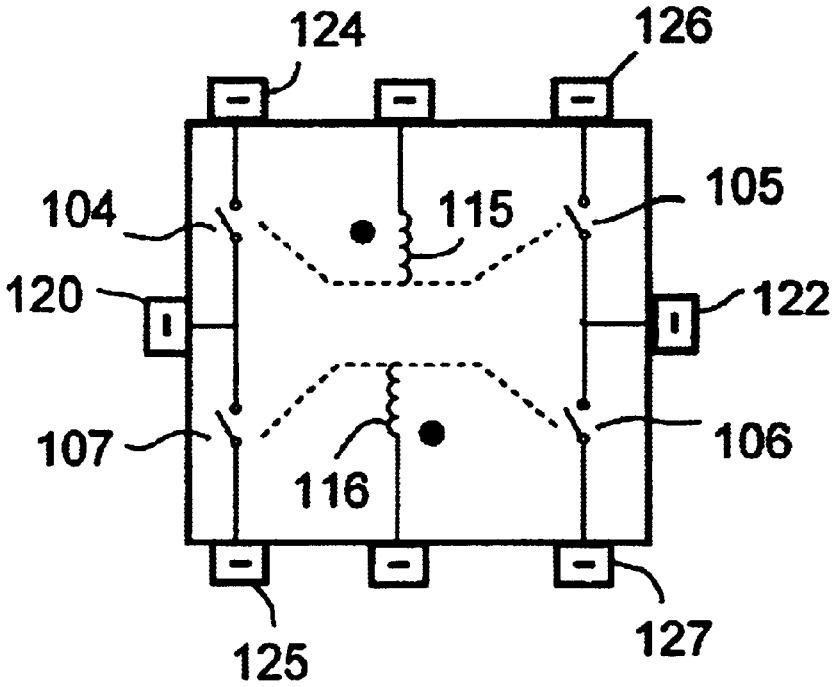
FIG. 16 is a schematic representation of the novel cross point switch of FIG. 15.

Because coil portions 115 and 116 are wound in different directions, when a switching current is supplied across coil 103, switches 104 and 105 operate together (e.g. close or open) and switches 106 and 107 operate together and opposite to switches 104 and 105. Thus, as can be seen in FIG. 16, contact 120 can be connected to either contact 124 or 125 and, simultaneously, contact 122 will be connected to either contact 126 or 127. As explained above, the switches are latching so that they remain in a selected position even after switching current is removed. The switch illustrated in FIGS. 15 and 16 is a 1×2 cross point switch.

Figure 17:
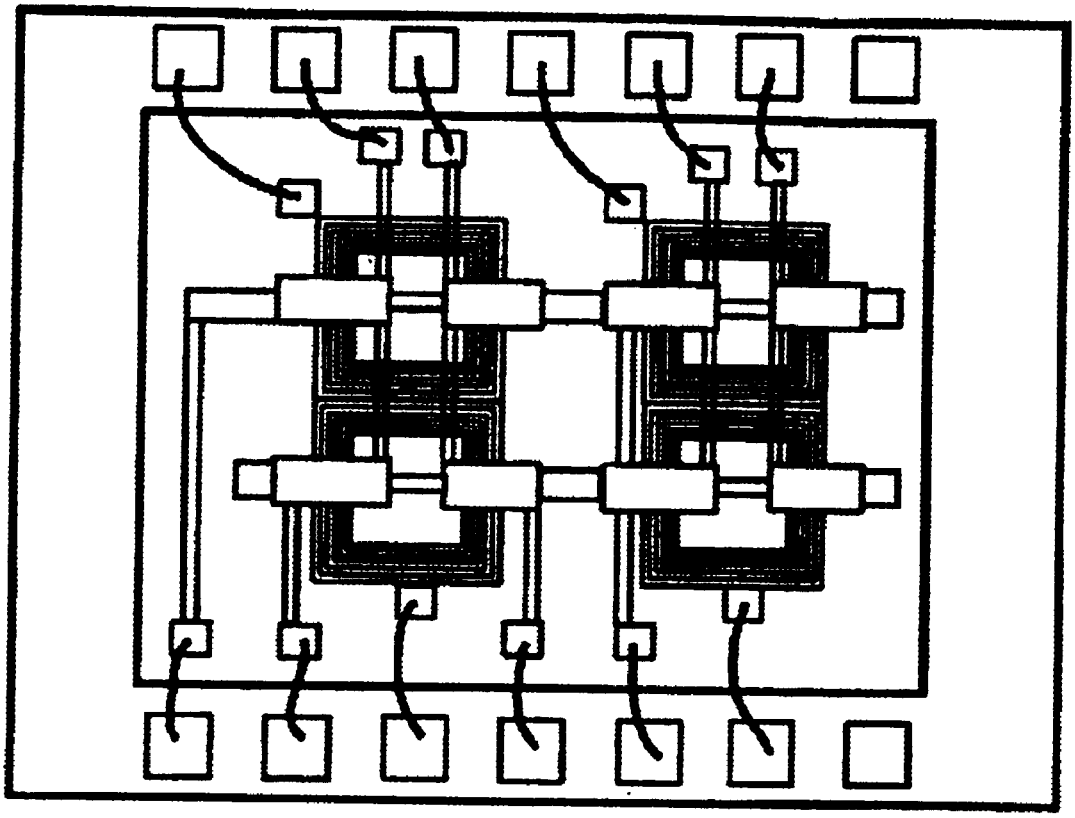
FIG. 17 is a view in top plan of a 2×2 differential cross point switch.
Figure 18:
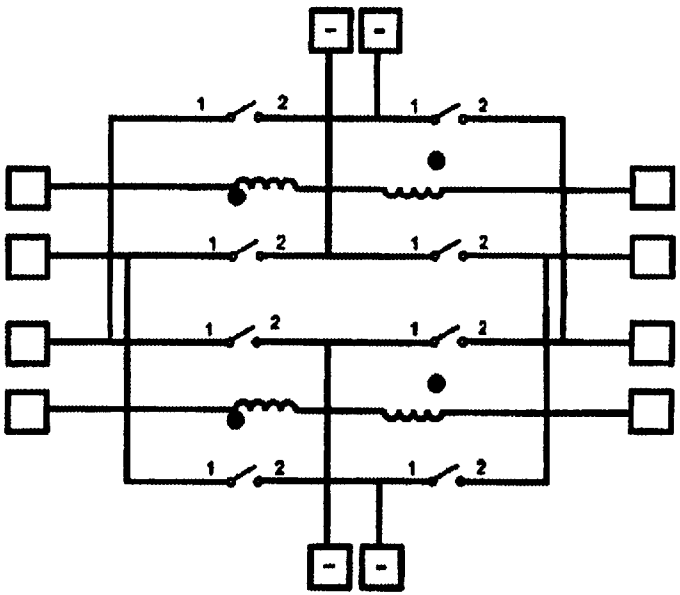
FIG. 18 is a schematic representation of the 2×2 differential cross point switch of FIG. 17.
Figure 19:
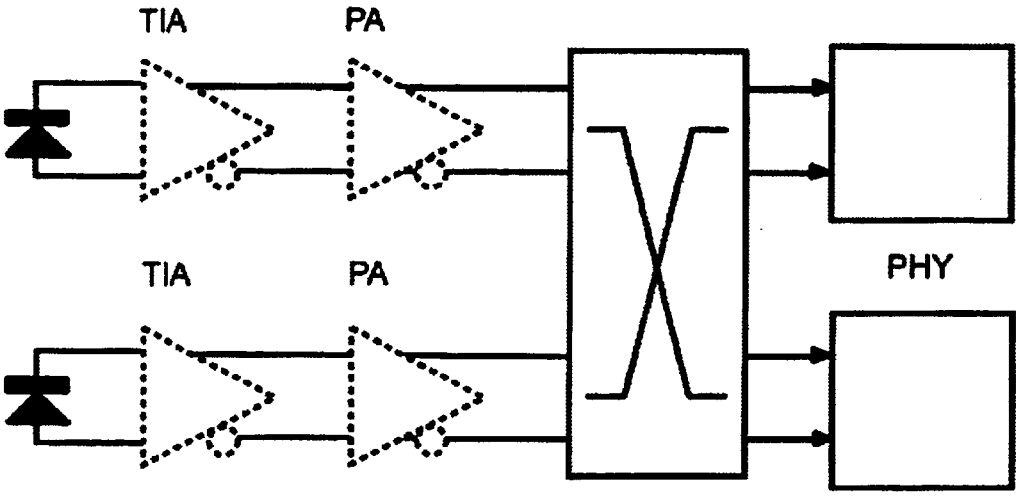
FIG. 19 is a simplified block diagram of a pair of optical fiber channels incorporating the cross point switch of FIG. 15.

Referring additionally to FIG. 17, a 2×2 cross point switch is illustrated in which two 1×2 cross point switches are fabricated in tandem. Each of the two 1×2 cross point switches is similar in construction and operation to the 1×2 cross point switch illustrated in FIG. 15. Further, a schematic diagram illustrating the electrical contacts and other components is illustrated in FIG. 18. It can be seen from FIG. 18 that any of the contacts can be connected to any of the other contacts through a proper switching of the various switches incorporated. Two channels of optical fiber electronics are illustrated in FIG. 19 with a 2×2 cross point switch, similar to the switch illustrated in FIG. 17, incorporated therein. It will be understood that any desired and convenient number of 1×2 cross point switches can be connected together to provide unlimited switching between all contacts in a system.

Thus, it can be seen that latching micro magnetic relays provide many advantages when used in filters, such as high frequency band pass filters and the like, because the latching micro magnetic relays have very low insertion loss and high Q at very high frequency (up to 20 GHz) and are simple to fabricate. Further, micro magnetic switching apparatus can be fabricated from the latching micro magnetic relays that perform a plurality of tasks with the application of small switching currents.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

What is claimed is:

1. Micro magnetic switching apparatus comprising:

a base;

a permanent magnet supported by the base;

a coil supported by the base so as to define a plurality of sides and connected to provide a magnetic field when activated; and a plurality of latching micro magnetic relays each including a magnetic cantilever positioned to open a first electric circuit in a first orientation and to close the first electric circuit in a second orientation, one each of the plurality of latching micro magnetic relays mounted on the base adjacent each of the plurality of sides of the coil, each latching micro magnetic relay further positioned adjacent the permanent magnet so as to be latched in one of the first and second orientations when the coil is not activated and to switch to the other of the first and second orientations when the coil is activated and to be latched in the other of the first and second orientations by the permanent magnet.

2. Micro magnetic switching apparatus as claimed in claim 1 wherein the coil is generally rectangularly shaped to define four sides.

3. Micro magnetic switching apparatus as claimed in claim 1 wherein the base includes a semiconductor substrate.

4. Micro magnetic switching apparatus as claimed in claim 3 further including a plurality of electronic components mounted on the substrate and connected to form the first electric circuit.

5. Micro magnetic switching apparatus as claimed in claim 4 wherein the first electric circuit includes a switchable filter and the plurality of electronic components includes capacitors and inductances.

6. Micro magnetic switching apparatus as claimed in claim 5 wherein the switchable filter includes a bandpass filter.

7. Micro-magnetic switching apparatus as claimed in claim 5 wherein the switchable filter is constructed to operate at a first frequency with the plurality of latching micro magnetic relays in the first orientation and at a second, different frequency, with the plurality of latching micro magnetic relays in the second orientation.

* * * * *